US010916822B2

(12) United States Patent
Itoh et al.

(10) Patent No.: US 10,916,822 B2
(45) Date of Patent: Feb. 9, 2021

(54) ANTENNA DEVICE AND METHOD FOR PRODUCING ANTENNA DEVICE

(71) Applicant: RICOH COMPANY, LTD., Tokyo (JP)

(72) Inventors: Naohiro Itoh, Hyogo (JP); Takashi Otsuki, Hyogo (JP)

(73) Assignee: RICOH COMPANY, LTD., Tokyo (JP)

( * ) Notice: Subject to any disclaimer, the term of this patent is extended or adjusted under 35 U.S.C. 154(b) by 36 days.

(21) Appl. No.: 15/956,786

(22) Filed: Apr. 19, 2018

(65) Prior Publication Data

US 2018/0342780 A1 Nov. 29, 2018

(30) Foreign Application Priority Data

May 29, 2017 (JP) ..... 2017-105822

(51) Int. Cl.

| | |
|---|---|
| ***H01Q 7/08*** | (2006.01) |
| ***H01P 3/08*** | (2006.01) |
| ***H01Q 13/10*** | (2006.01) |
| ***H01Q 13/20*** | (2006.01) |
| ***H01Q 1/36*** | (2006.01) |
| ***H01Q 7/00*** | (2006.01) |

(52) U.S. Cl.

CPC ..... *H01P 3/081* (2013.01); *H01Q 1/36* (2013.01); *H01Q 7/005* (2013.01); *H01Q 7/08* (2013.01); *H01Q 13/106* (2013.01); *H01Q 13/206* (2013.01)

(58) Field of Classification Search

CPC ..... H01Q 7/00–08; H01Q 1/22; H01Q 9/27

USPC ..... 343/787, 788, 895

See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 8,391,927 | B2 * | 3/2013 | Castaneda | H01Q 21/30 455/562.1 |
| 9,214,728 | B2 * | 12/2015 | Tsubaki | H01Q 19/00 |
| 10,062,956 | B2 * | 8/2018 | Ito | H01Q 1/48 |
| 2005/0088342 | A1 * | 4/2005 | Parsche | H01Q 1/38 343/700 MS |
| 2005/0092836 | A1 * | 5/2005 | Kudo | G06K 7/10316 235/436 |

(Continued)

FOREIGN PATENT DOCUMENTS

| | | |
|---|---|---|
| JP | 9-247025 | 9/1997 |
| JP | 2000-214275 | 8/2000 |

(Continued)

*Primary Examiner* — Hasan Z Islam

(74) *Attorney, Agent, or Firm* — Xsensus LLP

(57) ABSTRACT

An antenna device includes an antenna body, a circuit board, a joint, a transmission line conductor, and a line conductor. The antenna body includes a magnetic body and a conducting wire wound around the magnetic body in a spiral shape. The joint is disposed on the circuit board and coupled to an end of the conducting wire. The transmission line conductor is coupled to the joint. The line conductor is coupled to one of the end of the conducting wire and the transmission line conductor. At least one of a pattern and a length of the line conductor is changeable to adjust an equivalent impedance value of the antenna body.

10 Claims, 7 Drawing Sheets

(56) References Cited

U.S. PATENT DOCUMENTS

| | | | | |
|---|---|---|---|---|
| 2005/0219139 | A1* | 10/2005 | Kimura | H01Q 1/3241 343/788 |
| 2007/0080878 | A1* | 4/2007 | McLean | H01Q 13/106 343/725 |
| 2009/0284423 | A1* | 11/2009 | Yi | H01Q 1/2283 343/702 |
| 2012/0062433 | A1* | 3/2012 | Balanis | H01Q 1/38 343/720 |
| 2014/0320355 | A1* | 10/2014 | Saito | H01Q 1/38 343/702 |
| 2015/0116168 | A1* | 4/2015 | Yosui | H01Q 1/2208 343/722 |
| 2016/0028160 | A1 | 1/2016 | Otsuki | |
| 2016/0087330 | A1* | 3/2016 | Kato | H01Q 1/243 343/702 |
| 2016/0261026 | A1* | 9/2016 | Han | H01Q 1/243 |
| 2016/0315389 | A1* | 10/2016 | Imai | H01Q 1/24 |
| 2017/0229777 | A1* | 8/2017 | Kim | H01Q 1/243 |
| 2017/0271766 | A1 | 9/2017 | Itoh | |

FOREIGN PATENT DOCUMENTS

| | | |
|---|---|---|
| JP | 2002-141725 | 5/2002 |
| JP | 2007-164479 | 6/2007 |
| JP | 2014-103591 | 6/2014 |
| JP | 2014-179850 | 9/2014 |
| JP | 2015-042007 | 3/2015 |
| WO | WO2004/030148 A1 | 4/2004 |
| WO | WO2013/145623 A1 | 10/2013 |

* cited by examiner

ANTENNA DEVICE AND METHOD FOR PRODUCING ANTENNA DEVICE

CROSS-REFERENCE TO RELATED APPLICATIONS

This patent application is based on and claims priority pursuant to 35 U.S.C. § 119(a) to Japanese Patent Application No. 2017-105822, filed on May 29, 2017, in the Japan Patent Office, the entire disclosure of which is hereby incorporated by reference herein.

BACKGROUND

Technical Field

Embodiments of the present disclosure relate to an antenna device and a method for producing an antenna device.

Related Art

Communication devices of a proximity-type magnetic field coupling system used in, e.g., near field communication (NFC) are widespread as such communication devices are built in mobile phones, smart phones, and wearable terminal devices. Along with high functionality and downsizing of such terminal devices, communication antenna devices of the proximity-type magnetic field coupling system have been downsized. One approach to a decrease in communication distance along with downsizing terminal devices involves providing an antenna device in which a coil is wound around a magnetic body. Since such an antenna device is less susceptible to the influence of metal, the antenna device extends the communication distance.

SUMMARY

In one embodiment of the present disclosure, a novel antenna device includes an antenna body, a circuit board, a joint, a transmission line conductor, and a line conductor. The antenna body includes a magnetic body and a conducting wire wound around the magnetic body in a spiral shape. The joint is disposed on the circuit board and coupled to an end of the conducting wire. The transmission line conductor is coupled to the joint. The line conductor is coupled to one of the end of the conducting wire and the transmission line conductor. At least one of a pattern and a length of the line conductor is changeable to adjust an equivalent impedance value of the antenna body.

Also described is a novel method for producing an antenna device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1A:
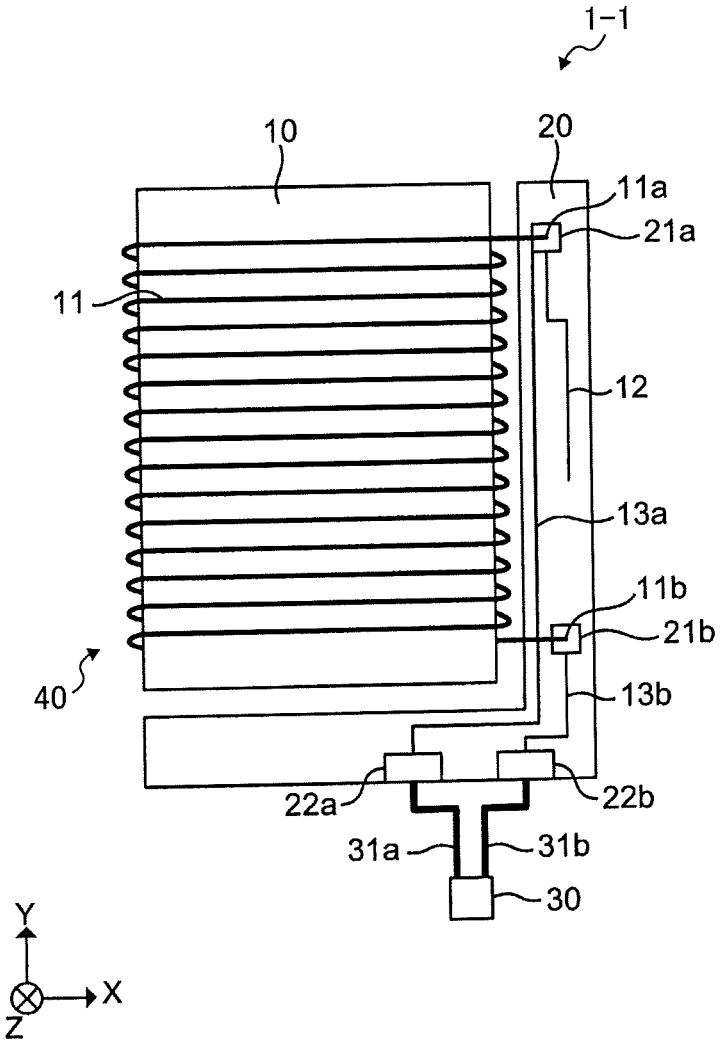
FIG. 1A is a plan view illustrating a configuration of an antenna device according to Embodiment 1.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

Embodiment 1

Figure 1B:
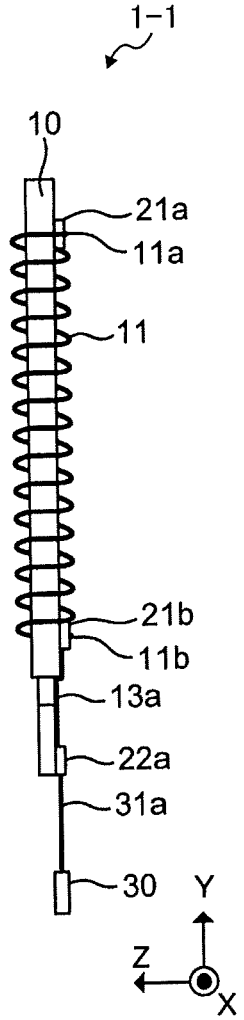
FIG. 1B is a side view of the antenna device of FIG. 1A.

Initially with reference to FIGS. 1A and 1B, a description is given of a configuration of an antenna device according to Embodiment 1.

FIG. 1A is a plan view illustrating a configuration of an antenna device 1-1 according to Embodiment 1. FIG. 1B is a side view of the antenna device 1-1, as viewed from the left side in FIG. 1A.

As illustrated in FIGS. 1A and 1B, the antenna device 1-1 includes, e.g., an antenna body 40. The antenna body 40 includes a magnetic body 10 having a rectangular flat shape and a conducting wire 11. The conducting wire 11 is wound around the magnetic body 10 in a spiral shape so as to be substantially parallel to a short-side direction of the magnetic body 10. The antenna device 1-1 further includes a flexible printed circuit (FPC) board 20 placed near the magnetic body 10. On, e.g., a front side of the FPC board 20 are pads 21*a* and 21*b*, a strip-shaped line conductor 12, and connectors 22*a* and 22*b*. The pad 21*a* is coupled to a first end 11*a* of the conducting wire 11. The pad 21*b* is coupled to a second end 11*b* of the conducting wire 11. The strip-shaped line conductor 12 is coupled to the pad 21*a* to adjust an equivalent impedance value of the antenna device 1-1. The equivalent impedance value includes equivalent inductance (L), capacitance (C), and resistance (R) values. The connector 22*a* is coupled to the pad 21*a* via a strip-shaped transmission line conductor 13*a*. The connector 22*b* is coupled to the pad 21*b* via a strip-shaped transmission line conductor 13*b*. The connectors 22*a* and 22*b* are coupled to a connector 30 via transmission line cables 31*a* and 31*b*, respectively. The connector 30 is further coupled to a wireless transceiver circuit.

In FIGS. 1A and 1B, the line conductor 12 is disposed on the FPC board 20 so as to branch out from one of the first end 11*a* of the conducting wire 11 and the transmission line conductor 13*a*, thus constructing a so-called stub conductor for the antenna device 1-1.

In the antenna device 1-1 according to Embodiment 1 described above, the line conductor 12 disposed on the FPC board 20 is cut, for example, thereby changing an impedance value of the conducting wire 11 coupled to the antenna body 40 to change the equivalent impedance value of the antenna device 1-1. Thus, the equivalent impedance value of the antenna device 1-1 is adjusted. In Embodiment 1, for example, the line conductor 12 is shortened to reduce an equivalent inductance value (L) and an equivalent resistance value (R) of the equivalent impedance value of the antenna device 1-1.

On the other hand, variation depending on how a conducting wire is wound may lead to variation in the equivalent impedance value, and further to variation in resonance frequency and quality factor (Q) of an antenna device. Such variation may degrade power supply characteristics and communication characteristics of a transceiver circuit coupled to the antenna device. Hence, in the present embodiment, the equivalent impedance value of the antenna device 1-1 is adjusted as described above, to prevent degradation of the power supply characteristics and the communication characteristics of the transceiver circuit coupled to the antenna device 1-1.

Embodiment 2

Figure 2A:
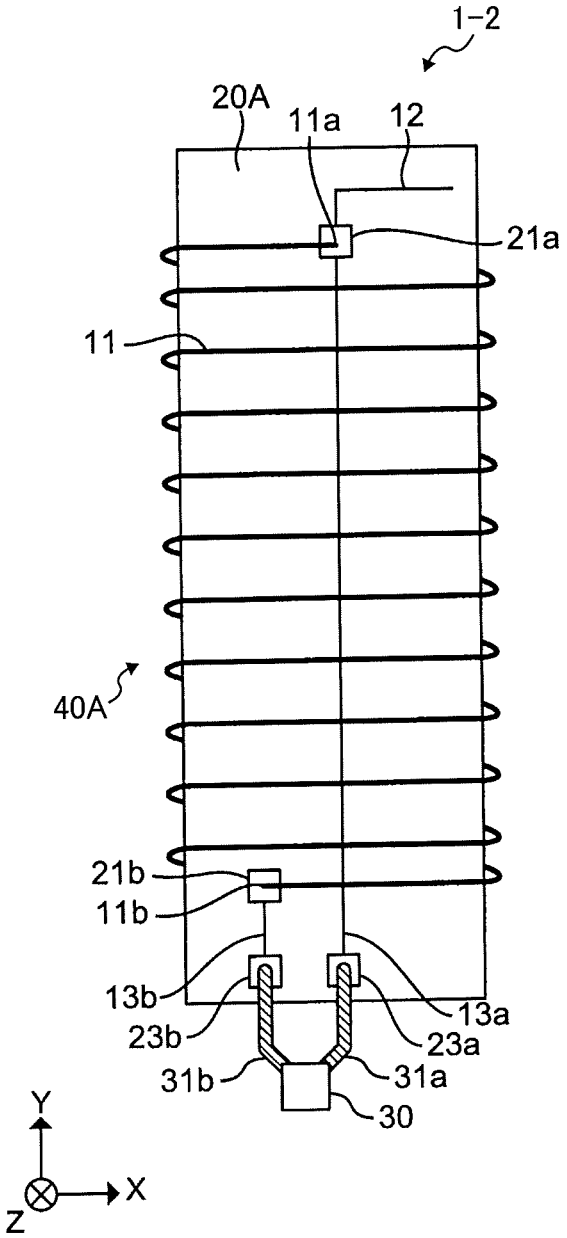
FIG. 2A is a plan view illustrating a configuration of an antenna device according to Embodiment 2.
Figure 2B:
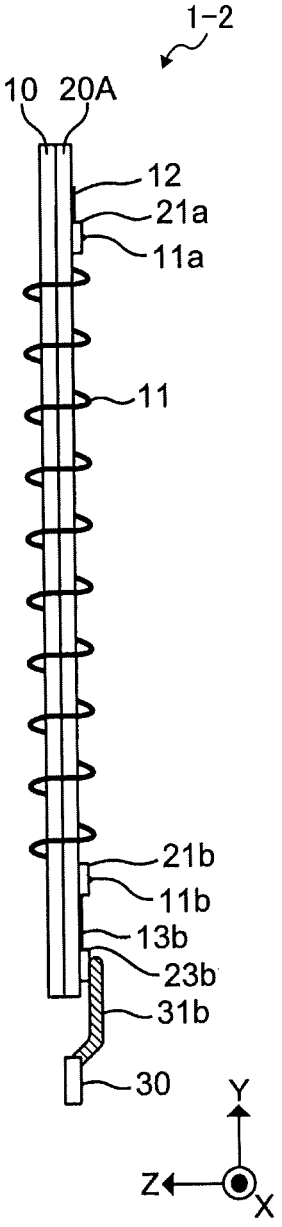
FIG. 2B is a side view of the antenna device of FIG. 2A.

Referring now to FIGS. 2A and 2B, a description is given of a configuration of an antenna device according to Embodiment 2.

FIG. 2A is a plan view illustrating a configuration of an antenna device 1-2 according to Embodiment 2. FIG. 2B is a side view of the antenna device 1-2, as viewed from the left side in FIG. 2A.

In FIGS. 2A and 2B, the antenna device 1-2 according to Embodiment 2 is different from the antenna device 1-1 of FIGS. 1A and 1B in the following points.

Firstly, the antenna device 1-2 includes a flat FPC board 20A instead of the FPC board 20. The FPC board 20A has a plane size substantially equal to a plane size of the magnetic body 10.

Secondly, the FPC board 20A is superimposed on the magnetic body 10, thus being coupled to each other as an integrated part. The conducting wire 11 of an antenna body 40A is wound around the magnetic body 10 and the FPC board 20 A thus integrated in a spiral shape so as to be substantially parallel to the short-side direction of the magnetic body 10. Note that, in FIG. 2B, the magnetic body 10 and the FPC board 20A have a substantially identical thickness. However, the thickness may be changed as appropriate to the device design.

Thirdly, the antenna device 1-2 includes pads 23*a* and 23*b* instead of the connectors 22*a* and 22*b* illustrated in FIG. 1A.

In FIGS. 2A and 2B, the line conductor 12 is disposed on the FPC board 20A so as to branch out from one of the first end 11*a* of the conducting wire 11 and the transmission line conductor 13*a*, thus constructing a so-called stub conductor for the antenna device 1-2.

In the antenna device 1-2 according to Embodiment 2 described above, the line conductor 12 disposed on the FPC board 20A is cut, for example, thereby changing the impedance value of the conducting wire 11 coupled to the antenna body 40A of the antenna device 1-2 to change the equivalent impedance value of the antenna device 1-2. Thus, the equivalent impedance value of the antenna device 1-2 is adjusted. In Embodiment 2, for example, the line conductor 12 is shortened to reduce the equivalent inductance value (L) and the equivalent resistance value (R) of the equivalent impedance value of the antenna device 1-2. In addition, the antenna device 1-2 according to Embodiment 2 has advantages similar to advantages of the antenna device 1-1 according to Embodiment 1.

Embodiments 3A and 3B

Figure 3A:
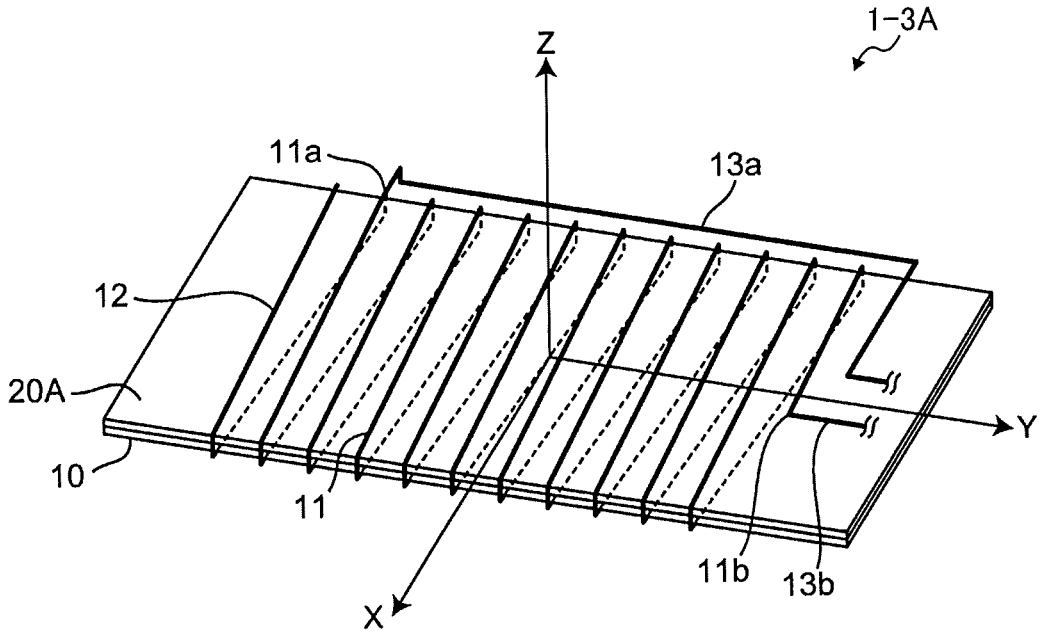
FIG. 3A is a perspective view illustrating a configuration of an antenna device according to Embodiment 3A.
Figure 3B:
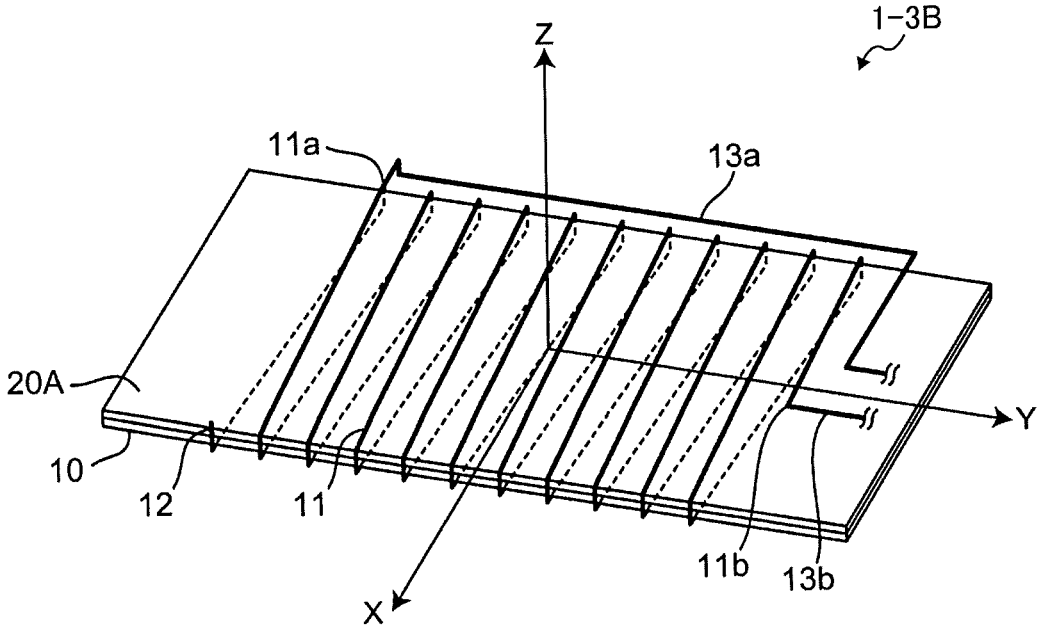
FIG. 3B is a perspective view illustrating a configuration of an antenna device according to Embodiment 3B.

Referring now to FIGS. 3A and 3B, a description is given of a configuration of an antenna device according to Embodiment 3A and a configuration of an antenna device according to Embodiment 3B.

FIG. 3A is a perspective view illustrating a configuration of an antenna device 1-3A according to Embodiment 3A. FIG. 3B is a perspective view illustrating a configuration of an antenna device 1-3B according to Embodiment 3B.

Compared to the antenna device 1-2 according to Embodiment 2 of FIGS. 2A and 2B, the line conductor 12 of the antenna device 1-3A according to Embodiment 3A has a length of one turn while the line conductor 12 of the antenna device 1-3B according to Embodiment 3B has a length of half a turn.

The equivalent impedance value depends on the material of the magnetic body 10 and the winding size of the conducting wire 11. In the present embodiment, an equivalent inductance value of several n henries (H) and an equivalent resistance value of several ohms (Ω) can be reduced. The line conductor 12 can exhibit great advantages as a stub conductor compared to typical line conductors.

Embodiment 3C

Figure 3C:
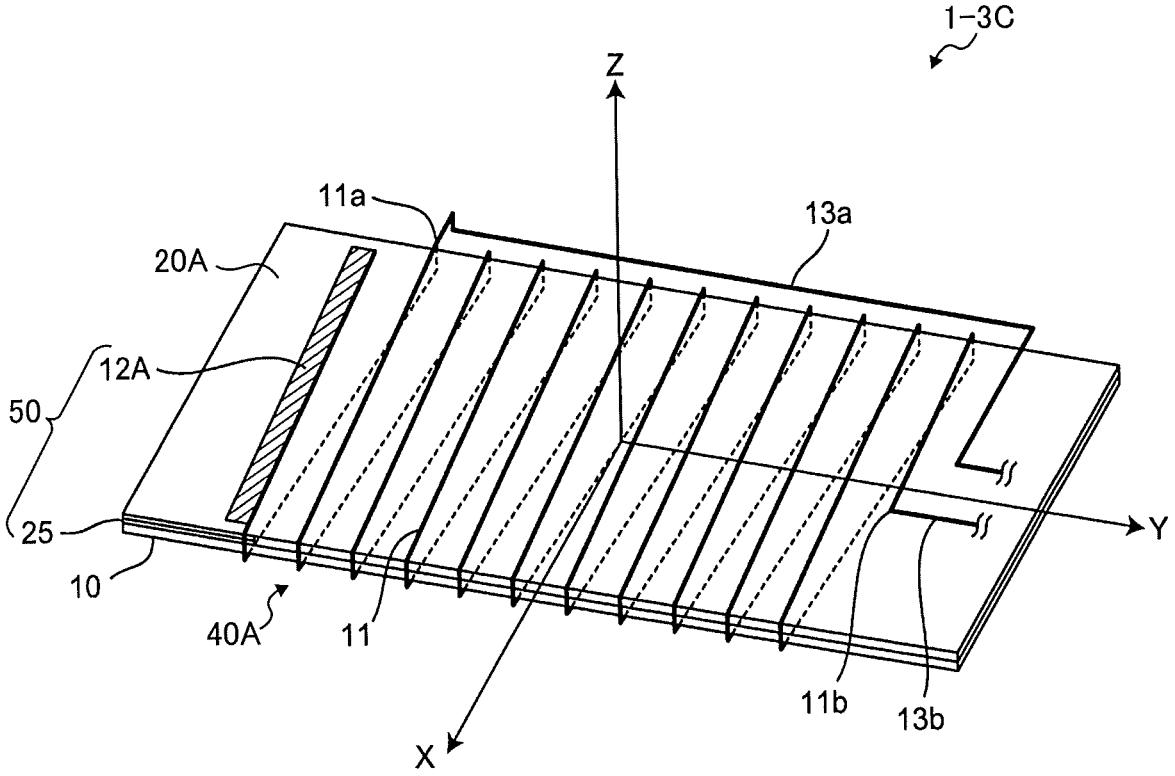
FIG. 3C is a perspective view illustrating a configuration of an antenna device according to Embodiment 3C.

Referring now to FIG. 3C, a description is given of a configuration of an antenna device according to Embodiment 3C.

FIG. 3C is a perspective view illustrating a configuration of an antenna device 1-3C according to Embodiment 3C.

In FIG. 3C, the antenna device 1-3C according to Embodiment 3C is different from the antenna device 1-3A of FIG. 3A in the following points. Firstly, the antenna device 1-3C includes a strip-shaped line conductor 12A instead of the line conductor 12. The strip-shaped line conductor 12A is wider than the line conductor 12. Secondly, a ground conductor 25 is disposed below a position where the line conductor 12A is disposed, and between the FPC board 20A and the magnetic body 10.

In FIG. 3C, the line conductor 12A and the ground conductor 25 construct a capacitor 50 having an equivalent capacitance value between the line conductor 12A and the ground conductor 25. In other words, capacitance exists between the line conductor 12A and the ground conductor 25.

In the antenna device 1-3C according to Embodiment 3C described above, the line conductor 12A disposed on the FPC board 20A is cut, for example, thereby changing the impedance value of the conducting wire 11 coupled to the antenna body 40A of the antenna device 1-3C to change the equivalent impedance value of the antenna device 1-3C. Thus, the equivalent impedance value of the antenna device 1-3C is adjusted. In Embodiment 3C, for example, the line conductor 12A is shortened to reduce an equivalent capacitance value (C) and the equivalent resistance value (R) of the equivalent impedance value of the antenna device 1-3C. In addition, the antenna device 1-3C according to Embodiment 3C has advantages similar to the advantages of the antenna device 1-1 according to Embodiment 1.

Embodiment 4A

Figure 4A:
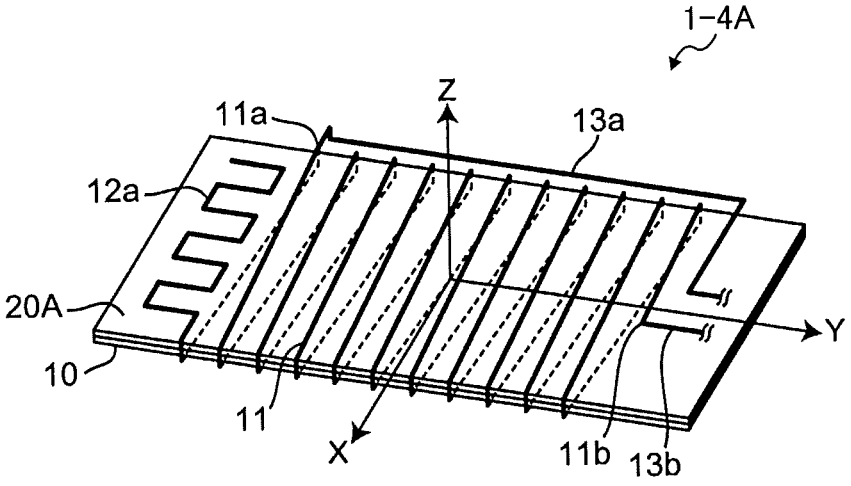
FIG. 4A is a perspective view illustrating a configuration of an antenna device according to Embodiment 4A.

Referring now to FIG. 4A, a description is given of a configuration of an antenna device according to Embodiment 4A.

FIG. 4A is a perspective view illustrating a configuration of an antenna device 1-4A according to Embodiment 4A.

In FIG. 4A, the antenna device 1-4A according to Embodiment 4A is different from the antenna device 1-3A according to Embodiment 3A of FIG. 3A in that the antenna device 1-4A includes a line conductor 12*a* instead of the line conductor 12. The line conductor 12*a* is disposed in a meandering shape, so as to extend in the short-side direction of the FPC board 20A. That is, the line conductor 12*a* meanders and extends in the short-side direction of the FPC board 20A. In other words, the line conductor 12*a* forms a meander line or a meander wiring pattern. Such a configuration increases the equivalent inductance value (L) and the equivalent resistance value (R) of the equivalent impedance value of the antenna device 1-4A, compared to the antenna device 1-3A of Embodiment 3A.

Embodiment 4B

Figure 4B:
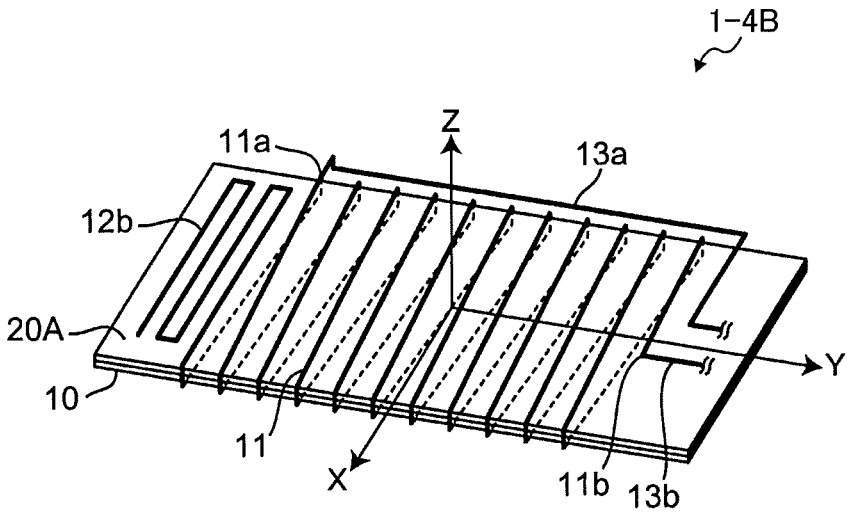
FIG. 4B is a perspective view illustrating a configuration of an antenna device according to Embodiment 4B.

Referring now to FIG. 4B, a description is given of a configuration of an antenna device according to Embodiment 4B.

FIG. 4B is a perspective view illustrating a configuration of an antenna device 1-4B according to Embodiment 4B.

In FIG. 4B, the antenna device 1-4B according to Embodiment 4B is different from the antenna device 1-3A according to Embodiment 3A of FIG. 3A in that the antenna device 1-4B includes a line conductor 12*b* instead of the line conductor 12. The line conductor 12*b* is disposed in a meandering shape, so as to extend in a long-side direction of the FPC board 20A. That is, the line conductor 12*b* meanders and extends in a longitudinal direction of the FPC board 20A. In other words, the line conductor 12*b* forms a meander line or a meander wiring pattern. Such a configuration increases the equivalent inductance value (L) and the equivalent resistance value (R) of the equivalent impedance value of the antenna device 1-4B, compared to the antenna device 1-3A of Embodiment 3A.

Embodiment 4C

Figure 4C:
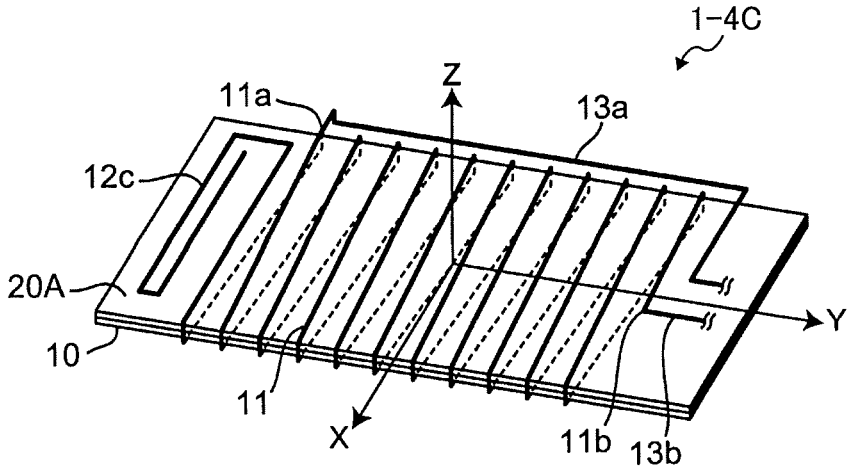
FIG. 4C is a perspective view illustrating a configuration of an antenna device according to Embodiment 4C.

Referring now to FIG. 4C, a description is given of a configuration of an antenna device according to Embodiment 4C.

FIG. 4C is a perspective view illustrating a configuration of an antenna device 1-4C according to Embodiment 4C.

In FIG. 4C, the antenna device 1-4C according to Embodiment 4C is different from the antenna device 1-3A according to Embodiment 3A of FIG. 3A in that the antenna device 1-4C includes a line conductor 12*c* disposed in a spiral shape (i.e., spiral line conductor 12*c*), instead of the line conductor 12. Such a configuration increases the equivalent inductance value (L) and the equivalent resistance value (R) of the equivalent impedance value of the antenna device 1-4C, compared to the antenna device 1-3A of Embodiment 3A.

Embodiment 5

Figure 5A:
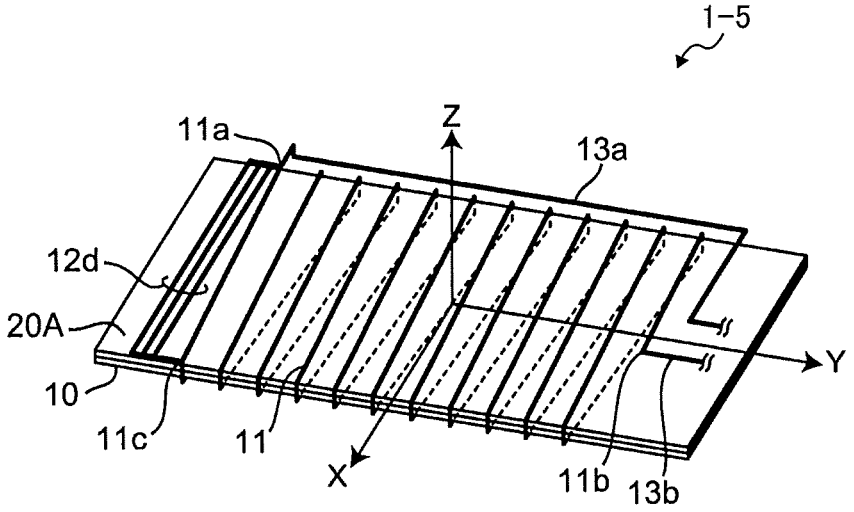
FIG. 5A is a perspective view illustrating a configuration of an antenna device according to Embodiment 5.
Figure 5B:
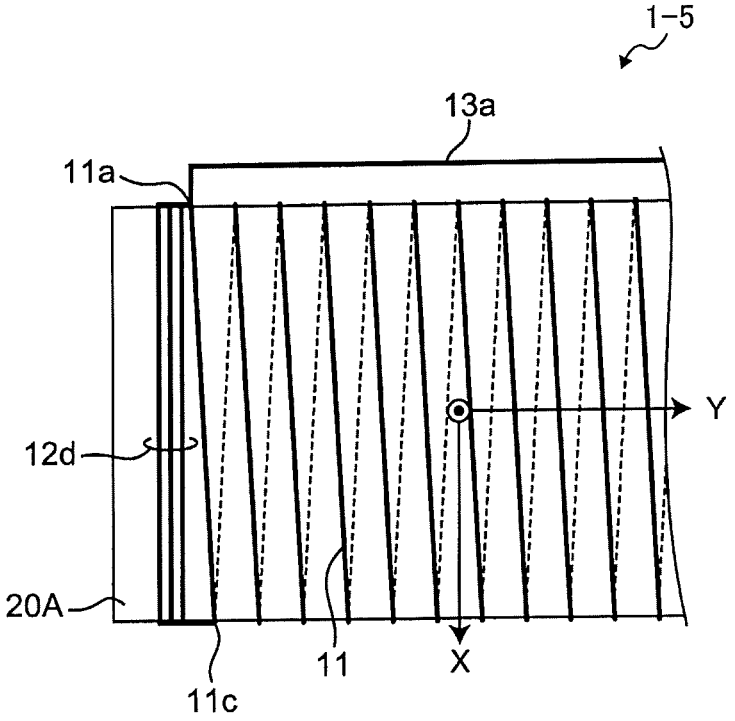
FIG. 5B is a plan view of the antenna device of FIG. 5A.

Referring now to FIGS. 5A and 5B, a description is given of a configuration of an antenna device according to Embodiment 5.

FIG. 5A is a perspective view illustrating a configuration of an antenna device 1-5 according to Embodiment 5. FIG. 5B is a plan view of the antenna device 1-5 of FIG. 5A.

Figure 5C:
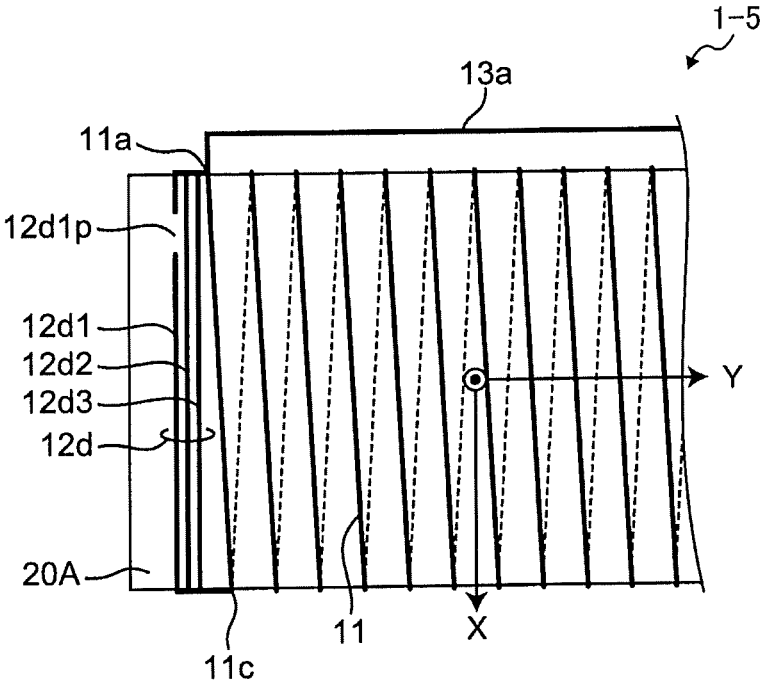
FIG. 5C is a plan view illustrating a method for adjusting an equivalent impedance value in the antenna device of FIGS. 5A and 5B.

In FIGS. 5A and 5B, the antenna device 1-5 according to Embodiment 5 is different from the antenna device 1-3A according to Embodiment 3A of FIG. 3A in that the antenna device 1-5 includes a line conductor 12*d* instead of the line conductor 12. The antenna device 1-5 according to Embodiment 5 further includes a side conducting wire 11*c* that couples the conducting wire 11 to the line conductor 12*d* side by side. The line conductor 12*d* includes three straight line conductors 12*d*1, 12*d*2, and 12*d*3 coupled in parallel as illustrated in FIG. 5C, thereby forming two rectangles on the FPC board 20A. Such a configuration increases the equivalent inductance value (L) and the equivalent resistance value (R) of the equivalent impedance value of the antenna device 1-5, compared to the antenna device 1-3A of Embodiment 3A.

FIG. 5C is a plan view illustrating a method for adjusting the equivalent impedance value in the antenna device 1-5 of FIGS. 5A and 5B.

As illustrated in FIG. 5C, for example, a part of the line conductor 12*d*1 is cut, thereby forming a cut portion 12*d*1*p*. Such a configuration increases the equivalent inductance value (L) of the equivalent impedance value of the antenna device 1-5 while decreasing the equivalent resistance value (R) of the equivalent impedance value of the antenna device 1-5, compared to the antenna device 1-5 illustrated in FIGS. 5A and 5B. The equivalent impedance value can be finely changed, thus being finely adjusted, by changing the number of line conductors to be cut among the three line conductors 12*d*1, 12*d*2, and 12*d*3.

Variation of Embodiment 5

Figure 5D:
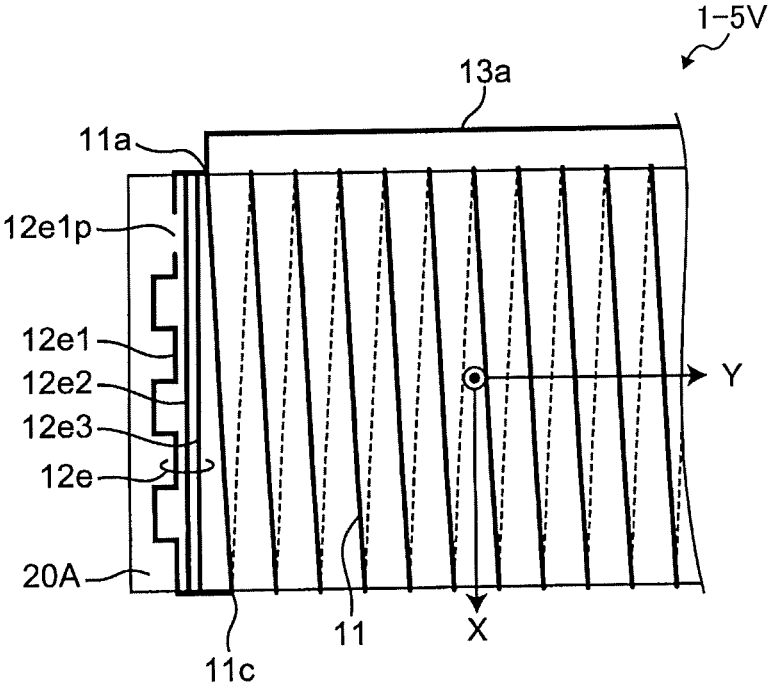
FIG. 5D is a plan view illustrating a method for adjusting the equivalent impedance value in an antenna device as a variation of the antenna device according to Embodiment 5.

Referring now to FIG. 5D, a description is given of a variation of the antenna device according to Embodiment 5 described above.

FIG. 5D is a plan view illustrating a method for adjusting the equivalent impedance value in an antenna device 1-5V as a variation of the antenna device 1-5 according to Embodiment 5.

In FIG. 5D, the antenna device 1-5V as a variation of the antenna device 1-5 according to Embodiment 5 is different from the antenna device 1-3A according to Embodiment 3A of FIG. 3A in that the antenna device 1-5V includes a line conductor 12*e* instead of the line conductor 12. The line conductor 12*e* includes three straight line conductors 12*e*, 12*e*2, and 12*e*3 coupled in parallel, thereby forming two rectangles on the FPC board 20A. As illustrated in FIG. 5D, the line conductor 12*e* is disposed in a meandering shape. That is, the line conductor 12*e*1 meanders. In other words, the line conductor 12*e*1 forms a meander line or a meander wiring pattern. Such a configuration increases the equivalent inductance value (L) and the equivalent resistance value (R) of the equivalent impedance value of the line conductor 12*e* of the antenna device 1-5V, compared to the line conductor 12*d*1 of Embodiment 5 illustrated in FIG. 5C.

As illustrated in FIG. 5D, for example, a part of the line conductor 12*e* is cut, thereby forming a cut portion 12*e*1*p*. Such a configuration increases the equivalent inductance value (L) of the equivalent impedance value of the antenna device 1-5V while decreasing the equivalent resistance value (R) of the equivalent impedance value of the antenna device 1-5V. The equivalent impedance value can be finely changed, thus being finely adjusted, by changing the number of line conductors to be cut among the three line conductors 12*e*, 12*e*2, and 12*e*3.

Differences between typical antenna devices and the antenna devices according to the embodiments of the present disclosure.

For example, loop antenna devices including an antenna module for a terminal device typically adjust inductance (L), capacitance (C), and resistance (R) values (hereinafter referred to as LCR values) of the antenna devices. In such antenna devices, an extra pattern is prepared beforehand and cut in an inspection process to adjust the LCR values of the antenna devices. On the other hand, spiral antenna devices may still face a situation that wires of the spiral antenna devices are easily broken, hampering the adjustment.

Generally, in such spiral-winding antenna devices, variation in areas of winding is directly related to variation in equivalent LCR values. The variation in equivalent LCR values further varies the resonance frequency and the quality factor (Q) of antenna devices, and leads to degradation of the communication characteristics and the power supply characteristics.

Hence, according to the embodiments of the present disclosure, a line conductor is disposed on a printed circuit board (PCB) as a stub conductor, thereby changing an impedance of a conducting wire and a copper foil pattern of an antenna device, thus adjusting equivalent LCR values. The pattern of the line conductor is changeable by selection from the patterns illustrated in FIG. 4A through 4C, for example. Cutting the line conductors illustrated in the accompanying drawings also changes the pattern thereof. In other words, the changeable pattern of the line conductor includes a cut pattern.

Accordingly, the embodiments of the present disclosure address the situation described above, that is, the situation that the wire is easily broken, hampering the adjustment.

Variations.

In the embodiments described above, an FPC board is used as a circuit board. However, the circuit board is not limited thereto. Alternatively, a circuit board such as a dielectric substrate or a semiconductor substrate may be used.

In the embodiments described above, the pads 21*a* and 21*b*, the connectors 22*a* and 22*b*, or the pads 23*a* and 23*b* are disposed as connections or joints on the FPC board 20 or the FPC board 20A. However, the connections or joints are not limited thereto. Any connections or joints may be used such as terminals.

According to the embodiments described above, the antenna device reduces variation in equivalent impedance value, compared to typical antenna devices.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disks, hard disks, optical discs, magneto-optical discs, magnetic tapes, non-volatile memory cards, read only memories (ROMs), etc.

Alternatively, any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. An antenna device comprising:

an antenna body including a magnetic body and a conducting wire wound around the magnetic body in a spiral shape;

a circuit board;

a joint disposed on the circuit board and coupled to an end of the conducting wire;

a ground conductor; and a line conductor disposed on the circuit board to be coplanar with a surface of the circuit board, the line conductor being coupled to the end of the conducting wire to form a stub conductor for the antenna device, at least one of a pattern or a length of the line conductor changeable to adjust an equivalent impedance value of the antenna body, and the ground conductor and the line conductor construct a capacitor, wherein the ground conductor and the line conductor adjust a capacitance of the capacitor, thereby adjusting the equivalent impedance value of the antenna body.

2. The antenna device according to claim 1, wherein the magnetic body and the circuit board are superimposed on each other as an integrated part, and wherein the conducting wire is wound around the magnetic body and the circuit board thus integrated.

3. The antenna device according to claim 1,
wherein the line conductor meanders.

4. The antenna device according to claim 1,
wherein the line conductor is spiral.

5. The antenna device according to claim 1,
wherein the line conductor forms a rectangle.

6. The antenna device according to claim 1,
wherein the circuit board is a flexible printed circuit board.

7. The antenna device according to claim 1,
wherein the joint is one of a pad, a terminal, or a connector.

8. The antenna device according to claim 1,
wherein said at least one of the changeable pattern or the length of the line conductor includes a cut pattern.

9. The antenna device according to claim 1,
wherein the line conductor branches out from the end of the conducting wire to form the stub conductor for the antenna device.

10. The antenna device according to claim 1,
wherein the magnetic body is configured separately from the circuit board.

* * * * *